US009038332B1

(12) United States Patent
Littlestone et al.

(10) Patent No.: US 9,038,332 B1
(45) Date of Patent: May 26, 2015

(54) EXPLOSIVE BLAST SHIELD FOR BUILDINGS

(71) Applicant: The United States of America as represented by the Secretary of the Navy, Washington, DC (US)

(72) Inventors: Alyssa A. Littlestone, Washington, DC (US); Philip J. Dudt, North Bethesda, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 74 days.

(21) Appl. No.: 13/779,973

(22) Filed: Feb. 28, 2013

Related U.S. Application Data

(60) Provisional application No. 61/723,896, filed on Nov. 8, 2012.

(51) Int. Cl.
*F41H 5/007* (2006.01)
*F41H 5/04* (2006.01)

(52) U.S. Cl.
CPC ..... *F41H 5/0457* (2013.01); *F41H 5/0442* (2013.01)

(58) Field of Classification Search
CPC ..... F41H 1/02; F41H 5/023; F41H 5/04; F41H 5/0414; F41H 5/013; F41H 5/0421; F41H 5/0442; F41H 5/0492; F42D 5/05; F42D 5/045; E04H 9/04
USPC ..... 52/202, 782.1, 783.1; 89/36.01, 36.02, 89/904, 910, 917, 914, 930; 73/35.14; 156/60
See application file for complete search history.

(56) References Cited

U.S. PATENT DOCUMENTS

| | | | | |
|---|---|---|---|---|
| 1,344,722 | A | 6/1920 | Schulz | |
| 5,007,326 | A * | 4/1991 | Gooch et al. | 89/36.02 |
| 5,515,541 | A * | 5/1996 | Sacks et al. | 2/2.5 |
| 5,521,807 | A * | 5/1996 | Chen et al. | 363/21.04 |
| 5,580,629 | A * | 12/1996 | Dischler | 428/43 |
| 6,792,843 | B2 * | 9/2004 | Mohr et al. | 89/36.02 |
| 7,300,893 | B2 | 11/2007 | Barsoum et al. | |
| 7,350,450 | B1 * | 4/2008 | Chu et al. | 89/36.02 |
| 7,794,808 | B2 | 9/2010 | Dudt et al. | |
| 7,926,407 | B1 * | 4/2011 | Hallissy et al. | 89/36.02 |
| 7,938,053 | B1 * | 5/2011 | Dudt et al. | 89/36.02 |
| 8,001,880 | B2 | 8/2011 | White et al. | |
| 8,293,353 | B2 * | 10/2012 | Eleazer et al. | 428/119 |
| 8,375,841 | B2 * | 2/2013 | Bocini et al. | 89/36.02 |
| 2004/0216595 | A1 * | 11/2004 | Dickson | 89/36.02 |
| 2006/0213360 | A1 * | 9/2006 | Ravid et al. | 89/36.01 |

(Continued)

OTHER PUBLICATIONS

J.S. Davidson et al., Failure Mechanisms of Polymer-Reinforced Concrete Masonry Walls Subjected to Blast, Journal of Structural Engineering (Aug. 2005), pp. 1194-1205.

(Continued)

*Primary Examiner* — Jeanette E Chapman
(74) *Attorney, Agent, or Firm* — Richard A. Morgan

(57) ABSTRACT

A composite shield comprises a panel including an outer thin metallic strike surface layer, a highly strain rate hardening polymer layer and an inner structural armor plate layer. The structural armor plate layer has a multiplicity of traversing ports. The traversing ports have sufficient lateral area to allow deformation of the thin metallic strike surface layer and highly strain rate hardening polymer layer through the structural armor plate layer on the occurrence of explosive blast.

9 Claims, 7 Drawing Sheets

(56) References Cited

U.S. PATENT DOCUMENTS

| | | | | |
|---|---|---|---|---|
| 2009/0068453 | A1* | 3/2009 | Chung | 428/337 |
| 2011/0005695 | A1* | 1/2011 | Boone et al. | 160/377 |
| 2012/0174754 | A1* | 7/2012 | Salisbury et al. | 89/36.02 |

OTHER PUBLICATIONS

R.G.S. Barsoum et al., The Fascinating Behaviors of Ordinary Materials under Dynamic Conditions, AMMTIAC Quarterly, vol. 4, No. 4 (Mar. 2010), pp. 11-14.

R.H. Cole, "Diaphragm Gauges", Underwater Explosions, Princeton University Press, Princeton, NJ (1948), pp. 157-159.

G.S. Langdon et al., Perforated Plates as Passive Mitigation Systems, Defense Science Journal, vol. 58, No. 2, Mar. 2008, pp. 238-247.

A. Britan et al., Experimental and Numerical Study of Shock Wave Interaction With Perforated Plates, Journal of Fluids Engineering, vol. 126, May 2004, pp. 399-409.

H. Wadley et al., Compressive response to multilayered pyramidal lattices during underwater shock loading, International Journal of Impact Engineering, vol. 35, (2008), pp. 1102-1114.

G.J. Cooper, Protection of the Lung from Blast Overpressure by Thoracic Stress Wave Decouplers, Journal of Trauma: Injury, Infection and Critical Care, vol. 40, No. 3, (March Supplement 1996), S105-S110.

Y. Andreopoulos et al., Moving shocks through metal grids: their interaction and potential for blast wave mitigation, Shock Waves (2007) vol. 16, pp. 455-466.

A.A. Littlestone et al., Blast Frequency Control for Personnel Survivability, NSWCCD, West Bethesda, MD, Technical Report NSWCCD-66-TR-2012/20 (Aug. 2012).

* cited by examiner 2
3
38a
50
40
42
46
48
34a
34b
38c
32a
32b
36a
36b
30a
30b
G
38d
38b
55
55 D 6
138a
7
7

140
142
146
134a
134b
138c
132a
132b
136a
136b
130a
130b
G
6
138a
155a
155aa
155b
155bb
155c
155cc

155 D
140
146
155 D
138b
138d
146
138c
130a
G

EXPLOSIVE BLAST SHIELD FOR BUILDINGS

CROSS-REFERENCE TO RELATED APPLICATIONS

This application claims the benefit of provisional application 61/723,896 filed Nov. 8, 2012, for the invention of an Explosive Blast Shield for Buildings by Alyssa A. Littlestone and Philip J. Dudt. The provisional application is incorporated herein by reference it its entirety.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The invention relates to a shield to protect static structures and the like from explosive blast. In another embodiment the invention relates to ordnance and an explosive blast shield. More particularly, the invention relates to a composite panel having explosive blast pressure mitigating components.

2. Discussion of the Related Art

Opportunistic attack against people and buildings by explosives laden cars and trucks has become a challenge in the art of armor. The primary defense against attack on buildings is a perimeter vehicle barrier, often a concrete wall. However, explosive blast generates a pressure wave that continues past any perimeter barrier. If sufficient explosive is detonated, the pressure wave can travel with force to damage a concrete wall, generate concrete spall and cause additional property damage and personal injury.

Opportunistic attack on a building usually originates from ground level. Therefore, it is not necessary that the entire building facade be covered, only that the explosion field of view be at least partially blocked. In addition, any vehicle barrier should be sufficiently immobile to stop any incoming vehicle. For this purpose steel reinforced Jersey barriers, earthen dikes, steel reinforced concrete walls and decorative concrete planters filled with soil have been used. However, the pressure wave from an explosive blast continues around the immobile barrier to impact the target building.

There is a continuing need in the art for an explosive blast shield. There is a particular need for a shield that can be free standing or used in combination with a vehicle barrier and that is effective against ground level explosive pressure waves.

SUMMARY OF THE INVENTION

A composite shield comprises a panel including a ductile strike layer spaced from an inner structural armor plate layer. The ductile strike layer includes a metallic strike surface layer and a highly strain rate hardening polymer layer filling the space between the strike layer and the structural armor plate. In another embodiment, a confined highly strain rate hardening polymer fills the space between a metallic strike surface layer and a second metallic layer. The structural armor plate layer has traversing ports through it. Each traversing port has sufficient lateral area to allow deformation of the ductile strike layer and highly strain rate hardening polymer layer through the structural armor plate layer. The highly strain rate hardening polymer is sensitive to strain rates of $10^3$/second and greater and responds to these strain rates by hardening.

The multi-layer panel has blast wave dissipating properties. Any spall from the thin metallic layer and adhered polymer layer are defeated by a spall liner. The shield is used in combination with a vehicle barrier to mitigate an explosive blast wave directed against static structures, physical assets and people. The shield is used with or without a vehicle barrier to protect open, unconfined areas such as airport pavements, port facilities, tank farms and open areas where people gather.

DETAILED DESCRIPTION OF THE INVENTION

Figures 1, 2:
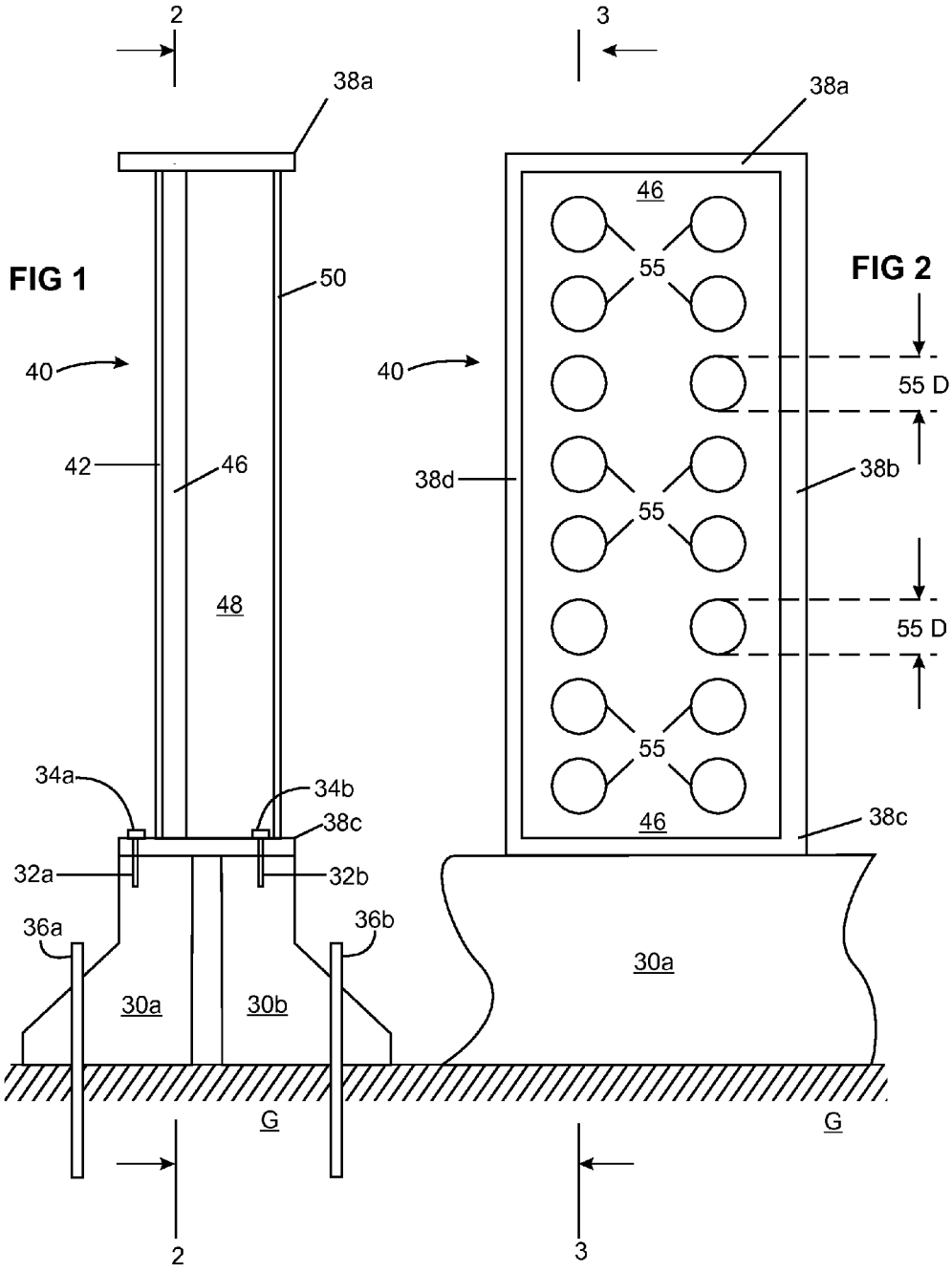
FIG. 1 is a cross-sectional side view of a shield in combination with a vehicle barrier.
FIG. 2 is a frontal view of the shield along section 2-2 in FIG. 1 showing ports.

The invention is described with reference to the drawing. The drawing discloses a preferred embodiment of the invention and is not intended to limit the generally broad scope of the invention as set forth in the claims. The drawing is schematic and is not drawn to scale.

First Embodiment

Reference is made to FIG. 1, FIGS. 1*a*, 1*b*, 1*c* and FIG. 2. A blast shield 40 comprises a composite panel and preferably a spall shield 50. Frame members 38*a*, 38*b*, 38*c* and 38*d* hold the spall shield 50 in laminar orientation and spaced from the composite panel 42, 46. The blast shield is the assembled combination of each individual component, i.e. element 42 (comprising 43, 44, 45), element 46 and element 50 which will be described. Blast shield 40 is mounted on and fixedly attached to a vehicle barrier shown here as Jersey barriers 30*a* and 30*b*. Heavy bolts 32*a* and 32*b* are attached to the concrete Jersey barriers which also include steel reinforcement bars (not shown) for collision integrity. Frame member 38*c* is fixedly attached to the Jersey barriers 30*a* and 30*b* by means of the heavy steel alloy bolts 32*a* and 32*b* and nuts 34*a* and 34*b*. Jersey barriers 30*a* and 30*b* are immobilized by steel reinforcement bars 36*a* and 36*b* driven into the ground G.

Alternative mounting of the blast shield are available. It is preferred that the blast shield be mounted in combination with an immobile vehicle barrier. For example, the blast shield may be mounted on an earthen dike, an earthen backed concrete wall, and the like. The usual objective is to elevate the blast shield so that the building or other asset is shielded as much as possible from direct view of a blast pressure wave. Alternative mounting (not shown) includes frame member 38*c* placed in contact with the ground G and immobilized with steel reinforcing bars or the like. This mounting alternative with the blast shield 40 attached to and immobilized on the ground G is referred to herein as "free standing." In another free standing mounting alternative, blast shield 40 is mounted on a concrete pad (not shown) in contact with ground G. This mounting alternative may be desirable when ground G soils are loose, thin, gravelly, muddy or otherwise less suitable for mounting purposes. It is well known in the art to select Jersey barriers, concrete pads, bolts, nuts, reinforcement bars and the like that are capable of withstanding and remaining immobile following vehicle ramming and explosive blast.

Additional alternative mounting of the blast shield are available. The blast shield may be used to shield portions of buildings. For example, the blast shield may be mounted to shield windows and doors. This can be accomplished in several ways. The blast shield may be mounted as a window or door shutter that is opened and closed as desired. The blast shield may be integrally mounted as part of a balcony so that it shields an elevated window or door from direct street view. Architecture panels comprising the shield may be attached to the building frame and positioned as an addition to an exterior surface on portions of static structures.

Laminar blast shield 40 comprises adjacent layers including a ductile thin strike layer 42 and a structural armor plate layer 46. Structural armor plate layer 46 may be included as a back layer. Preferably, the back layer is a spall liner 50. An effective placement of spall liner 50 is to position it a linear distance from structural armor plate layer 46 with an intervening air space 48. This configuration with an air space 48 layer is preferable to a configuration in which the blast shield 40 is in direct contact with the structural armor plate layer. The spall liner is considerably more effective in capturing spall if it is spaced from the structural armor plate layer 46 with an air space 48.

Strike layer 42 is defined as ductile so it must be thin. The ductile strike layer is capable of deforming into the underlying port under explosive blast pressure. The ductile strike layer will finally rupture when the blast pressure pushes the deformed composite to the fracture point on a stress-strain curve for the material (not shown). According to the invention, it is desirable for strike layer 42 to rupture if the explosive force is sufficient to cause this. Rupture takes full advantage of the capability of the materials selected for the strike layer 42 to mitigate blast energy. It is also desirable that the structural armor plate layer survive and that traversing ports subdivide the explosive blast wave, further mitigating blast energy.

Figure 1A:
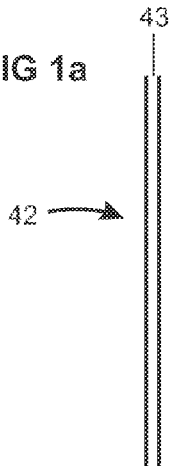
FIG. 1*a* is a cross-sectional side view showing a ductile strike layer consisting of a metallic strike surface layer.
Figure 1B:
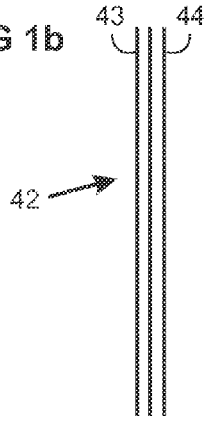
FIG. 1*b* is a cross-sectional side view showing a ductile strike layer consisting of a metallic strike surface layer and a highly strain rate hardening polymer layer.
Figure 1C:
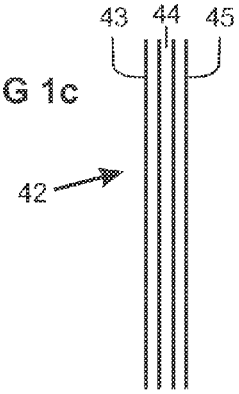
FIG. 1*c* is a cross-sectional side view showing a ductile strike layer consisting of a metallic strike surface layer, a highly strain rate hardening polymer layer and a second metallic layer.

FIG. 1*a* shows details of ductile strike layer 42. In this embodiment, strike layer 42 is a single metallic strike surface layer 43. In FIG. 1*b*, strike layer 42 is a composite of metallic strike surface layer 43 with a highly strain rate hardening polymer layer 44 backing adhered thereto. In FIG. 1*c*, ductile strike layer 42 is a composite of metallic strike surface layer 43 and a second metallic layer 45 with a highly strain rate hardening polymer layer 44 entirely filling the space between the two metallic layers, i.e., abutting both layers and thereby confined. All three variations of strike layer 42 are ductile. In each variation, the width of the one, two and three layer composite is thin. Ductility is essential for the composite to function according to the mechanism of the invention in mitigating explosive blast energy.

As seen in FIG. 1*a*, ductile strike layer 42 comprises layer 43 made of foil or sheet of ductile metal. At the lower end of the thickness range, 0.001 up to 0.006 inches, metallic strike layer 43 is described as foil. At 0.006 inches and above, metallic strike layer 43 is described as sheet. The range of thicknesses of strike surface layer 43 is 0.001 inch to 0.25 inches.

Examples of suitable materials for the ductile metallic strike surface layer 43 include aluminum, e.g. 1100 series, 5000 series and 6000 series aluminum sheet. Examples of steel include mild steel, austenitic stainless steels such as 316L and 310 and maraging steel. Other examples of suitable materials for layer 42 include 1100 copper and commercially pure grades of titanium. We have used 1100 series aluminum foil having a thickness down to 0.001 inches. In the Example we used aluminum 5052-H32 sheet, a ductile aluminum used for sheet metal fabrication. Aluminum 5052-H32 is commercially available in sheet thicknesses in the inventive range and is much stronger than 1100 series aluminum.

Structural armor plate layer 46 comprises a ballistic armor plate having a minimum Young's modulus of 1 million psi and a Poisson's ratio between 0.2 and 0.35. This is achieved with a 0.25-inch to 5-inch thick layer of a ballistic armor plate of a material such as surface hardened steel, titanium armor, aluminum-based ceramic, glass reinforced ballistic polymer and the like. Structural armor plate layer 46 has the physical characteristics of rolled homogeneous armor such as that produced to U.S. Military Specification MIL-A 12560 and the like. Examples of steel include high carbon content modified steel such as American Iron and Steel Institute (AISI) grade 4340 (Ni—Cr—Mo) steel or 4130 (Cr—Mo) steel. The steel may also be U.S. Military Specification MIL-A 46100 or MIL-A 12560 ballistic armor. Another steel is HY-130 (Ni—Cr—Mn—Mo). In the Example we used a naval steel plate commercially identified as HY-100 (Ni, Cr, Mo, Mn). HY-100 has a Young's modulus of 30 million psi and a Poisson's ratio of 0.280. The thickness of steel plate is 0.25 inches or more, preferable 0.25 inches to 5 inches. A steel plate thickness of 1 inch to 4 inches has been found to be effective and practical for the intended use. We have also used thick 6061-T6 aluminum plate.

A suitable titanium armor is titanium alloy Ti 6A1-4V. These ballistic armors are commercially available in thicknesses of 0.25 inches to 6 inches.

Attention is drawn to FIG. 2 which shows a frontal view of the shield along section 2-2 in FIG. 1. The structural armor plate layer 46 is modified with traversing ports 55 which pass completely through the armor plate layer 46. Traversing ports 55 have diameters 55D providing sufficient lateral area to allow deformation of the ductile strike layer including highly strain rate hardening polymer layer through the structural armor plate layer. Sufficient lateral area is defined by the ductile metallic strike surface layer material. It has been found experimentally that traversing port diameters of 0.25 inches to 2 inches are sufficient to allow deformation of the ductile metal sheet strike surface layer with adhered polymer into and through structural armor plate layer 46. In general, for the same metallic strike surface layer and polymer layer, a larger diameter port will allow the supported layer to rupture at a lower blast pressure than a smaller diameter port. This is due to the ductility of the composite layer. Therefore, relatively thicker strike surface and polymer layers should be combined with relatively larger diameter traversing ports to provide for deformation of the composite layers into the ports to dissipate blast energy.

Relatively thinner composite layers should be combined with relatively smaller diameter traversing ports. Excluded from the invention are ports that do not have sufficient diameter to allow transport of explosively deformed ductile metallic strike surface layer through them. For example, a plurality of smaller diameter perforations may provide considerable free area, but they do not allow extension of explosively deformed ductile metallic strike surface layer there through. That is, smaller diameter perforations do not allow the mechanism of the invention to function. The mechanism of the invention provides for a multiplicity of functioning diaphragms to dissipate blast force by deforming and rupturing the outer ductile metallic strike surface layer and highly strain rate hardening polymer layer.

Ports are formed by drilling, grinding, chemical machining and the like. Precision is not necessary for the diameters 55D of the traversing ports. Depending on the anticipated threat it may be desirable to provide variation in the diameters over the inventive range in the structural armor plate layer 46. Variation in diameter 55D provides sequential rupturing of disks. This, in combination with the underlying ported structural armor plate layer, modifies the blast pressure wave and dampens peak blast wave pressure impacting the target static structure. The ported structural armor plate layer provides additional segmenting and mitigation of the explosive blast wave.

The ductile strike layer 42 comprises a metallic strike surface layer 43. Between the strike surface layer 43 and the structural armor plate layer 46 is a highly strain rate hardening polymer layer 44 confined by completely filling the volume between the ductile metallic strike surface layer 43 and the structural armor plate layer 46.

Polymers have been found that are effective against explosive blast pressure penetration and projectile penetration. These polymers demonstrate high strain rate hardening when subjected to high strain rate loading. Impact by a projectile or explosive blast wave are examples of high strain rate loading. The transient rigidity is significantly increased when the polymer is confined. This physical response presents a transient, very high-strength barrier to a penetrator. The invention exploits this property to mitigate an explosive blast wave.

Highly strain rate hardening polymers include polyurea, polyurethane and mixtures of polyurea and polyurethane. Polyurea is preferred. The thickness of highly strain rate hardening polymer 44 is 0.005 to 0.25 inches and the same for polymer layer 144 in FIG. 7.

Polymers of the invention are referred to as highly strain rate hardening and high strain rate sensitivity hardening, among other similar variations in the terms. These polymers demonstrate particular sensitivity to strain rate increases. They are sensitive in rapidly hardening at strain rates of about $10^3$/second or greater, particularly about $10^4$/second or greater. Generally high strain rate sensitivity hardening polymers useful for the invention demonstrate a Young's modulus of 1000 psi to 4000 psi when tested at slow strain rates. At high strain rates in the range of 1,000/second to 1,000,000/second, the confined polymer demonstrates a Young's modulus of 350,000 psi to 500,000 psi or greater. When confined, the tensile strength increases from about 2,000-8000 psi to about 80,000 psi. By way of example, polyurea useful for the invention is sold commercially under trade names including Carboline® POLYCLAD® 707, Air Products VERSALINK® 1000 and SPI POLYSHIELD® Hi-E.

Highly strain rate hardening polymers are more fully discussed in inventor's U.S. Pat. No. 7,300,893 for Armor Including A Strain Rate Hardening Elastomer, incorporated herein by reference.

Figure 4:
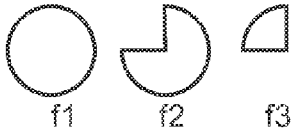
FIG. 4 is a schematic view of typical spall shapes.
Figure 3:
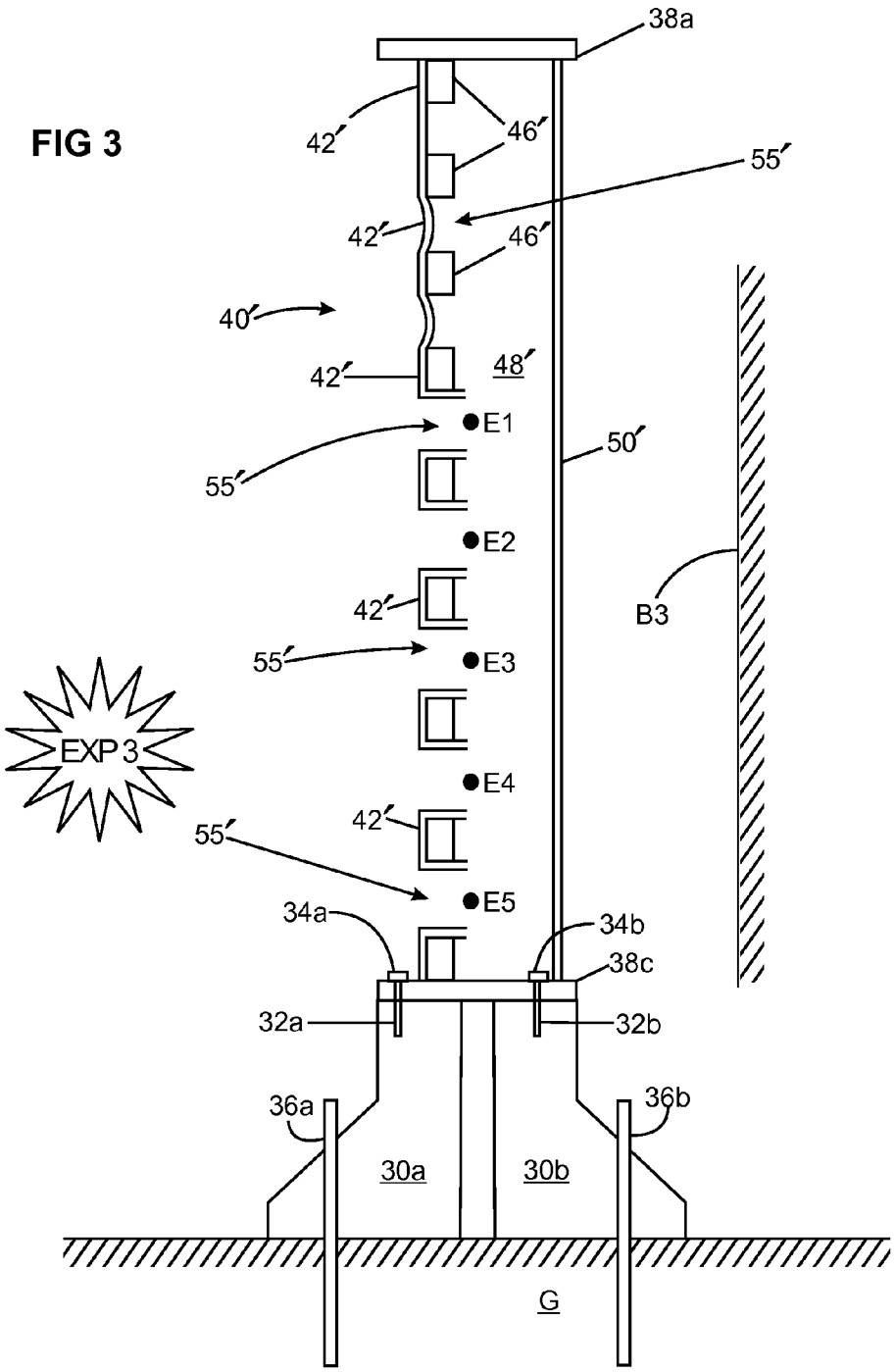
FIG. 3 is a cross-sectional side view of the shield along section 3-3 in FIG. 2 showing explosive blast deformation.

With sufficient explosive blast force, the outer ductile metal strike surface layer with adhered polymer passes completely through the structural armor plate layer 46, as shown in FIG. 3. At explosive blast pressures, fragments of unsupported ductile strike layer separate as spall. Common spall shapes are shown in FIG. 4 including a metallic disk f1, disk missing a petal f2 and petal f3 all with adhered polymer. Spall size and disk shape are an artifact of the traversing ports 55 through which segments of the ductile metal sheet strike surface layer 42 was forced by the explosive blast.

The metallic spall traverses air space 48 and impacts spall liner 50. Air space 48 is not essential, but is preferred because the presence of the air space demonstrates better spall capture by slowing spall speed. Although not essential, the presence of spall liner 50 is preferred. A spall liner has been found to capture essentially all spall generated by separation of the ductile metallic strike surface layer 42.

Spall liner 50 may be made of any of the materials known to be useful for this purpose. Spall liner 50 is ordinarily a polycarbonate layer. Polycarbonate is a projectile resisting material with good shock receiving characteristics. In thin sheets, polycarbonate stretches on impact, making it a good spall liner. In this capacity it prevents traverse of projectile fragments and spall through it. In general, the polycarbonate material has a thickness of 0.1 to 0.5 inches, preferably 0.1 to 0.3 inches. It has been found that besides the projectile resisting characteristics of the material, polycarbonate provides a stiff backing and makes the panel easier to mount. By way of example, LEXAN® is the trade name of an optically clear polycarbonate sold by SABIC Innovative Plastics, Pittsfield, Mass. 01201.

Other examples of effective materials useful as spall liners include glass-reinforced plastic, ultra high molecular weight polyethylene having about 10,000 to 250,000 polyethylene mers per polymer, e.g. DYNEEMA® and SPECTRA® fiber, and para-aramid fiber, e.g. KEVLAR® based fiber. These materials are commercially available. Selection of the specific material for use as a spall liner, including molecular weight and thickness, is an optimization and is within the ability of those trained in the art.

As shown in FIGS. 1 and 2, before the occurrence of explosive blast, laminar blast shield 40 includes adjacent layers; the ductile metallic sheet strike surface layer 42 and the structural armor plate layer 46. Spall liner 50 is the back layer. Spall liner 50 is spaced from structural armor plate layer 46 by air space 48. This blast shield is held in place by frame members 38*a* and 38*c* and frame members 38*b* and 38*d*. Traversing ports 55 through structural armor plate layer 46 are shown.

In FIG. 3, armor plate layer 46' and ports 55' correspond with armor plate layer 46 and ports 55 in FIG. 1 and FIG. 2. FIG. 3 shows a side view of the shield along section 3-3 in FIG. 2. FIG. 3 shows that the structural armor plate layer 46 is modified with traversing ports 55 which pass completely through the layer.

In addition to showing section 3-3 in FIG. 2, FIG. 3 shows post explosion blast shield 40' following the occurrence of explosive blast, schematically shown as explosive blast EXP3 directed against building B3. In FIG. 3, elements 30*a*, 30*b*, 32*a*, 32*b*, 34*a*, 34*b*, 36*a*, 36*b*, 38*a*, and 38*c* remain undamaged; that is, the same as shown in FIG. 1.

Blast shield 40' is blast shield 40 following deformation by explosive blast EXP3. Post blast structural armor plate layer 46' corresponds with structural armor plate layer 46 in FIG. 1. Following explosive blast EXP3, post blast ductile strike layer 42' has been distorted as has any highly strain rate hardening polymer layer (not shown in FIG. 3). At points E1, E2, E3, E4 and E5, fragments of strike layer 42' have been broken and separated at post blast traversing ports 55', resulting in spall. FIG. 4 shows common spall shapes ordinarily found. The size and disk shape are an artifact of the traversing ports 55' through which segments of the ductile metal strike surface layer 42' was forced by the explosive blast. Spall is coated on one surface with highly strain rate hardening polymer layer (not shown). Spall liner 50' is able to contain the spall and remain intact.

Laminar blast shield 40 is assembled by joining ductile metal strike surface layer 43, structural armor plate layer 46 and highly strain rate hardening polymer 44. For thicker polymer layers, joining is accomplished by constructing a mold. Metallic strike surface layer 43 and structural armor plate layer 46 are positioned in a frame, leaving a space between them to fill with polymer 44. The space is sealed by taping the sides and bottom of the mold with foam tape of sufficient width to prevent liquid polymer from flowing out. Fluid polymer is poured or infused into the space left in the mold and then cured. Curing is generally accomplished by holding the materials undisturbed in the frame for about 24 to 72 hours at room temperature. Curing at elevated temperature in an autoclave can be carried out to reduce curing time. This solidifies the polymer without leaving any voids or bubbles and attaches the polymer to surfaces. As a result the polymer is functionally confined and exhibits the required physical properties of a confined polymer.

For thinner polymer layers, joining is accomplished by film coating techniques. A foil sheet is laid out on a flat surface. Polymer is coated uniformly on the foil sheet and cured. In another case, there are two foil layers with polymer between them. This composite is made by laying a foil sheet out on a flat surface. Polymer is coated uniformly on the foil sheet. The second foil sheet is laid on the polymer and a roller is applied to remove any non-uniformity. The polymer composite is allowed to cure.

Theory

Inventors were inspired by their repeated observations of explosive blast pressure measurements on diaphragm gauges. A diaphragm gauge includes a metallic pressure sensing element that elastically flexes under the effect of a pressure difference across the element. For explosive blast pressure measurements, inventors used a ductile metallic sheet for the pressure sensing element. Ductile metallic sheet disks are mounted over a circular port and exposed to an explosive blast. The ductile metallic diaphragm responds with a dish shaped deflection, alternately referred to as hemispherical and concave. Explosive blast pressure is read by comparison of the deflected diaphragm with a set of dished explosive blast pressure-calibrated diaphragms. It is possible to construct a stress-strain curve of the material being tested by exposing disks to sequentially increased explosive charges.

Inventors found that ductile metallic diaphragms could be fabricated that dissipated considerable explosive blast pressure. This was achieved by selecting circular port diameter, selecting ductile metallic foil or sheet material and backing the ductile metallic foil or sheet with a highly strain rate hardening polymer. It was found that greater improvement in blast pressure mitigation could be achieved by additionally confining the highly strain rate hardening polymer. The ductile metal-polymer composite strike layer undergoes considerable deformation before it ruptures, consuming more blast energy than metallic foil or sheet alone. The function of the invention is to consume blast energy by deformation and rupture. It is desirable that rupture occurs to mitigate the most blast energy possible from the materials selected.

Thickness of the structural armor plate and circular port diameter are selected in view of the magnitude of the anticipated explosive threat. Armor plate thicknesses at the upper end of the inventive range are paired with thicker ductile strike layers to defeat a larger magnitude explosive threat. Armor plate thicknesses at the lower end of the inventive range are paired with thinner ductile strike layers to defeat an anticipated smaller magnitude explosive threat. Although any of the combinations of materials is effective for the intended purpose, it has been found during installation that 0.001 to up to 0.006 inch thick foils are more sensitive to simple handling damage when paired with larger diameter ports. Smaller port diameters provide more support for thin foils.

There is no simple method for calculating the rupture of a diaphragm gauge exposed to an explosive blast wave. Methods have been developed that rely on theoretical calculations corrected with empirical data. The methods are useful in reverse for estimating a useful measurement range for a diaphragm gauge and the point at which rupture may occur. By way of example, at explosive charge weights up to 20 pounds, the deformation of steel diaphragms is proportional to the 0.6 power of charge weight and the −1.2 power of charge stand-off distance. At explosive charge weights of 100 pounds or more, the deformation of steel diaphragms is proportional to the 0.5 power of charge weight and the −1.13 power of charge stand-off distance. Larger diameter ports allow for larger deformations. It is also possible to measure maximum deformation before rupture in the laboratory for various thicknesses of thin ductile metallic sheet material. These examples and additional examples provide the user with a method of selecting ductile metallic sheet material and thickness.

Finally, a layer of ballistic armor was selected that provided structural mounting for ductile metallic diaphragms. The ballistic armor was modified with circular ports. The ballistic armor improved blast survivability by providing blast pressure relief. This is caused by two phenomena. First, only a portion of the blast wave flows through ruptured ports. Another portion is reflected back from the ballistic armor surface. This is a significant pressure mitigation effect. Second, the pressure is reduced by flow through the ports. In addition, the presence of barriers and blast shields deters attempts against any target. That is, the presence of the instant shield deters explosive blast attacks as well as projectile attacks.

Second Embodiment

Figure 5A:
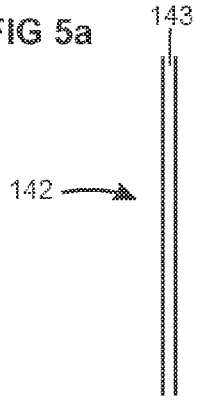
FIG. 5*a* is a cross-sectional side view showing a ductile strike layer consisting of a metallic strike surface layer.
Figure 5B:
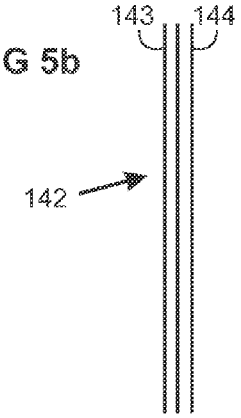
FIG. 5*b* is a cross-sectional side view showing a ductile strike layer consisting of a metallic strike surface layer and a highly strain rate hardening polymer layer.
Figure 5C:
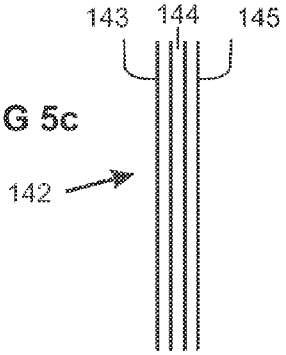
FIG. 5*c* is a cross-sectional side view showing a ductile strike layer consisting of a metallic strike surface layer, a highly strain rate hardening polymer layer and a second metallic layer.
Figures 5, 6:
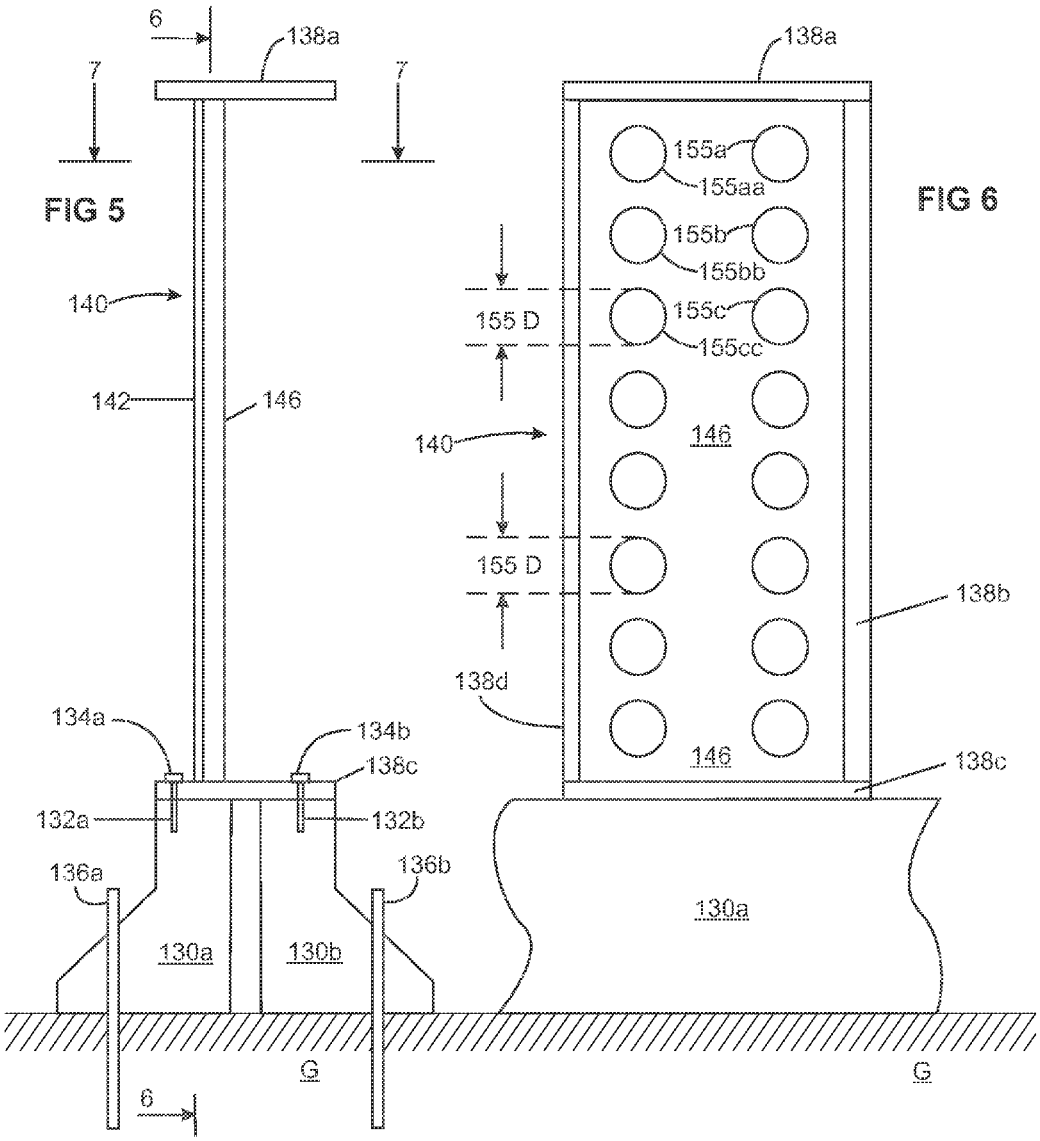
FIG. 5 is a cross-sectional side view of an alternate shield configuration in combination with a vehicle barrier.
FIG. 6 is a frontal view of the shield along section 6-6 in FIG. 5 showing port pairs.

In FIG. 5 and FIG. 6, blast shield 140 comprises a panel. In this embodiment there is no spall liner. Frame members 138*a*, 138*b*, 138*c* and 138*d* hold the blast shield 140 and allow mounting and fixed attachment to a vehicle barrier shown here as Jersey barriers 130*a* and 130*b*. Heavy bolts 132*a* and 132*b* are attached to the steel reinforced, concrete Jersey barriers. Frame member 138*c* is fixedly attached to the Jersey barriers 130*a* and 130*b* by means of heavy steel alloy bolts 132*a* and 132*b* and nuts 134*a* and 134*b*. Similarly, Jersey barriers 130*a* and 130*b* are immobilized with steel reinforcement bars 136*a* and 136*b* driven into the ground G.

The laminar blast shield 140 comprises adjacent layers comprising a ductile strike layer 142 and a structural armor plate layer 146. Ductile strike layer 142 corresponds with the ductile strike layer 42 described above.

FIG. 5*a* shows ductile strike layer 142. In this embodiment, strike layer 142 is a single metallic strike surface layer 143. In FIG. 5*b*, strike layer 142 is a composite of metallic strike surface layer 143 with highly strain-rate sensitivity hardening polymer layer 144 adhered thereto. In FIG. 5*c*, ductile strike layer 142 is a composite of metallic strike surface layer 143 and a second metallic layer 145 with a highly strain rate hardening polymer layer 144 entirely filling the space between the two metallic layers. All three variations of strike layer 142 are thin and ductile. Ductility is essential for the composite to function according to the mechanism of the invention.

Figure 7:
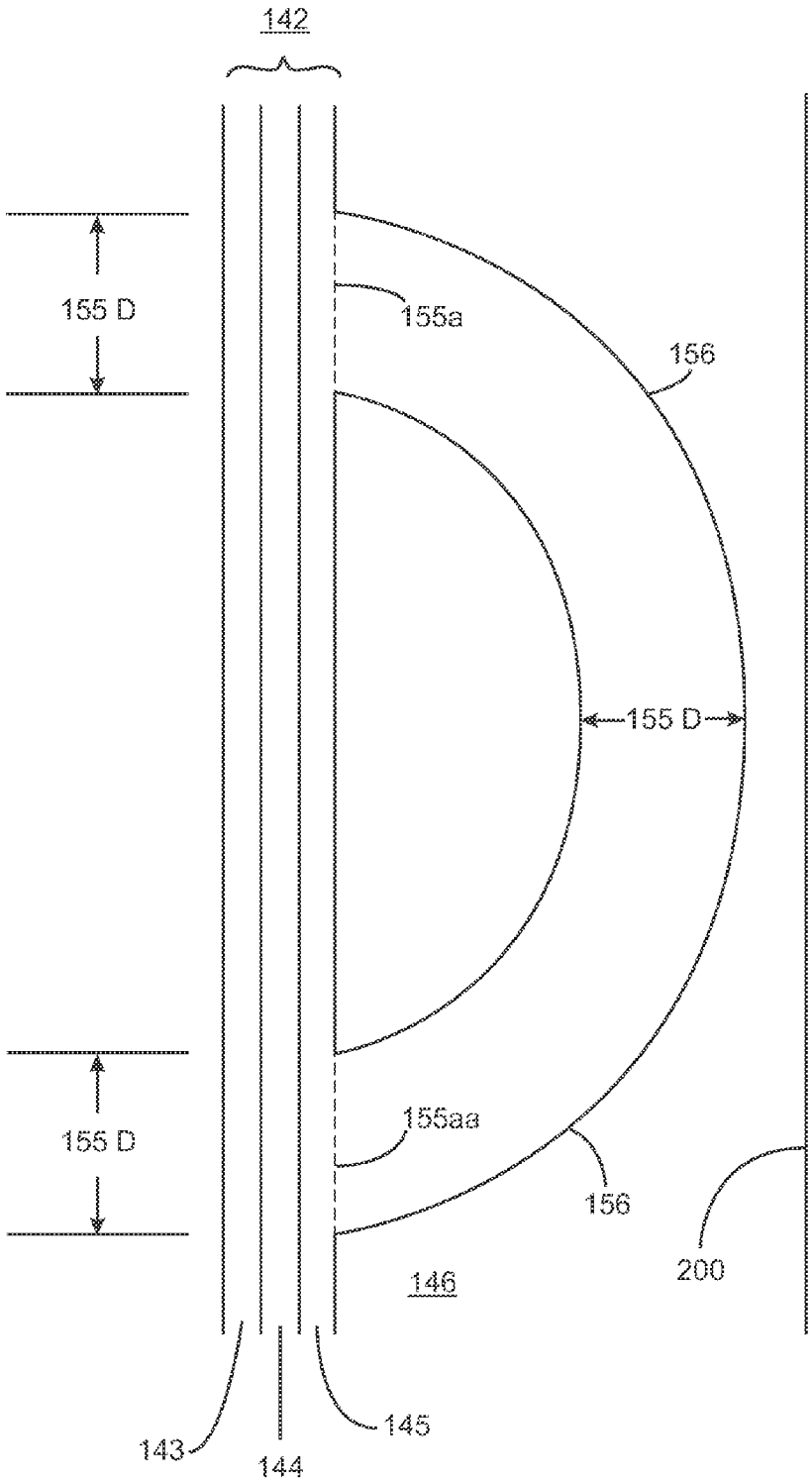
FIG. 7 is an overhead cross-sectional view of FIG. 5 along section 7-7 showing a sectioned conduit and port pairs.

FIG. 7 is overhead view of the shield along section 7-7 in FIG. 6. FIG. 7 shows ductile strike layer 142. In this embodiment, strike layer 142 is a composite of, in sequence: metallic strike surface layer 143, highly strain rate hardening polymer layer 144 and second metallic layer 145. The highly strain rate hardening polymer layer 144 entirely filling the space between the two metallic layers 143, 145 and is thereby confined by them. In an alternative, strike layer may comprise in sequence: metallic strike surface layer 143 and highly strain rate hardening polymer layer 144. The highly strain rate hardening polymer layer 144 entirely fills the space between the metallic strike surface layer 143 and the armor plate layer 145. In either alternative, the strike layer is thin and ductile. Ductility is essential for the composite to function according to the mechanism of the invention.

Strike surface layer 143 and second metallic layer 145 comprise a foil or sheet of ductile metal. At the lower end of the thickness range, 0.001 up to 0.006 inches, layer 143 and layer 145 are each described as foil. At a thickness of 0.006 inches and above they are each described as sheet. That is, the thickness range of each of metallic strike surface layer 143 and second metallic layer 145 is 0.001 inch to 0.25 inches.

Examples of suitable materials for the metallic strike surface layer 142 and the second metallic layer 145 include aluminum including 1100 series, 5000 series and 6000 series aluminum sheet. Examples of steel include mild steel, austenitic stainless steels such as 316L and 310 and maraging steel. Other suitable materials for layer 142 include 1100 copper and commercially pure grades of titanium.

The structural armor plate layer 146 comprises a ballistic armor plate having a minimum Young's modulus of 1 million psi and a Poisson's ratio between 0.2 and 0.35. This is achieved with a 0.5-inch to 5-inch thick layer of a ballistic armor plate of a material such as surface hardened steel, titanium armor, aluminum armor, ceramic, glass reinforced ballistic polymer and the like.

FIG. 6 shows a frontal view of the shield along section 6-6 in FIG. 5. The structural armor plate layer 146 is modified with port pairs 155*a* & 155*aa*, 155*b* & 155*bb*, and 155*c* & 155*cc*. The port pairs have diameters 155D providing sufficient lateral flow area to allow deformation of the outer ductile metallic strike layer and highly strain rate hardening polymer layer through the port pairs and into the structural armor plate layer 146. Sufficient lateral area is defined by the ductile metallic strike surface layer material. It has been found experimentally that port diameters of 0.25-inch to 2-inch are sufficient to allow deformation of the outer ductile metal strike layer with polymer adhered into structural armor plate layer 146.

FIG. 7 shows an overhead view of the shield along section 7-7 in FIG. 6. FIG. 7 specifically shows a cross sectional view of port pair 155*a* & 155*aa* and the connecting conduit 156. Conduit 156 has an approximately circular cross section. The circular cross section has a diameter of 155D which is the same as the diameters 155D of each port pair 155*a* & 155*aa*. Conduit 156 is entirely enclosed by and contained within structural armor plate layer 146. This is accomplished by specifying a diameter 155D of conduit 156 of 0.25 inches to 2 inches. The thickness of structural armor plate layer 146 is 1 inch to 5 inches. Conduit 156 is entirely contained within structural armor plate layer 146. Conduit 156 provides blast wave travel between port 155*a* and port 155*aa*. Fluid flow within conduit 156 is entirely contained and confined within structural armor plate layer 146. There is no escape from conduit 156 other than from port 155*a* and from port 155*aa*. Back wall 200 is shown.

Conduits are formed by drilling, grinding, casting, chemical machining and the like. The conduits may also be formed from pipes or tubing. The pipes or tubes are then backed with metal or polymer. Precision is not necessary in the diameters of the traversing ports. It is only preferred that the diameters in any structural armor plate layer 146 be relatively uniform.

Polymers have been found that are effective against explosive blast pressure and projectile penetration. These polymers demonstrate high strain rate hardening when subjected to highly rate loading. They become highly rigid when subjected to high rate loading by a projectile. The transient rigidity is significantly increased when the polymer is confined. This physical response creates a transient, very high-strength barrier to a penetrator.

Highly strain rate hardening polymers include polyurea, polyurethane and mixtures of polyurea and polyurethane. Polyurea is preferred. The thickness of highly strain rate sensitivity-hardening polymer 144 is 0.005 to 0.25 inches.

Generally, highly strain rate hardening polymers useful for the invention demonstrate a Young's modulus of 1000 psi to 4000 psi when tested at slow strain rates. At high strain rates in the range of 1,000/second to 1,000,000/second, the confined polymer demonstrates a Young's modulus of 350,000 psi to 500,000 psi or greater. When confined, the tensile strength increases from about 2,000-8000 psi to about 80,000 psi. By way of example, polyurea useful for the invention is sold commercially under trade names including Carboline® POLYCLAD® 707, Air Products VERSALINK® 1000 and SPI POLYSHIELD® Hi-E.

Theory

Figure 8:
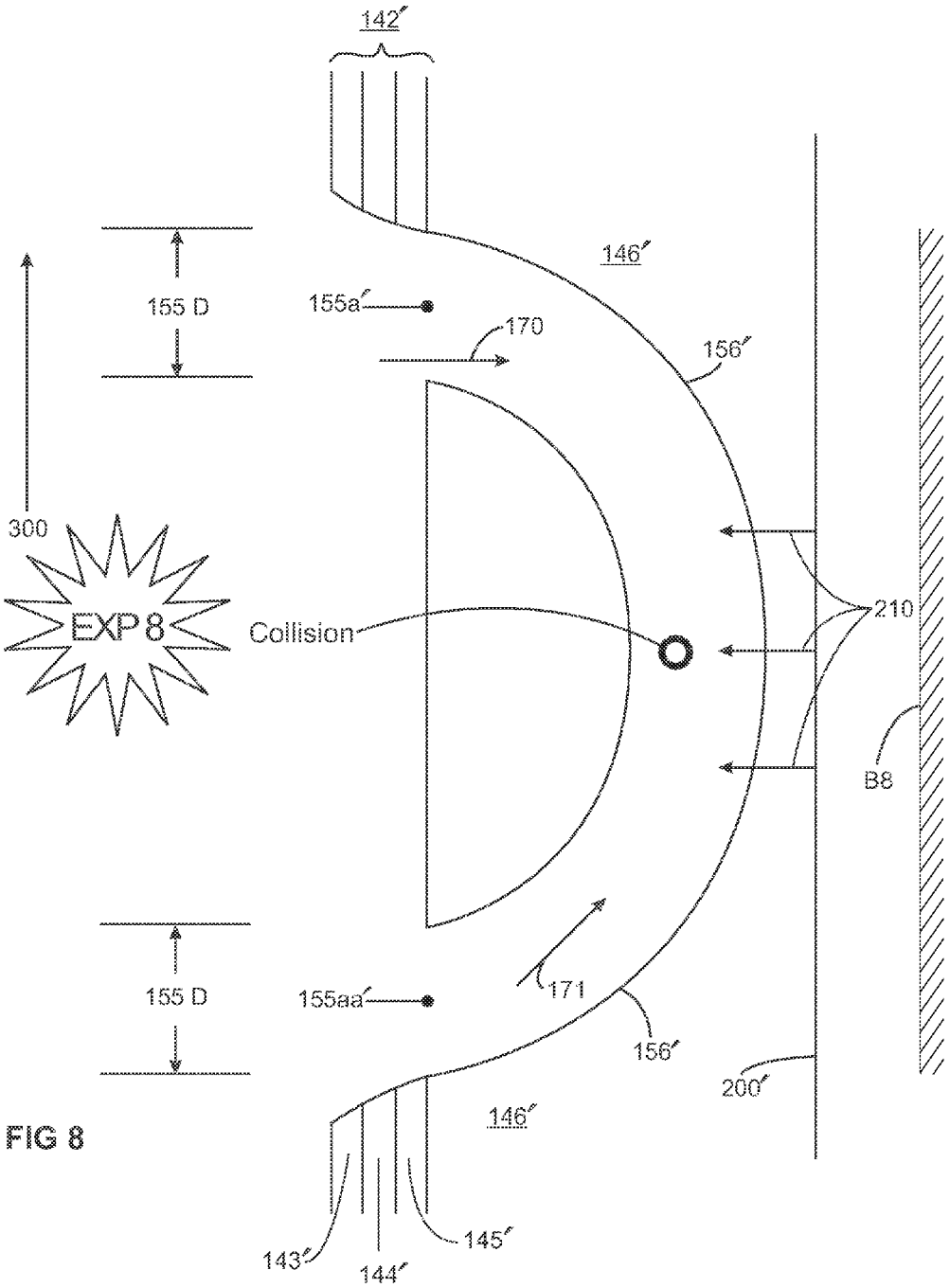
FIG. 8 is a schematic representation of explosive pressure waves in the conduit shown in FIG. 7 during an explosive blast.

FIG. 8 is a view of the structural armor plate layer 146 and conduit 156 of FIG. 7 immediately following explosive blast EXP8. In FIG. 8 the placement of explosive blast EXP8 is symbolic in that the size and spacing of explosive blast EXP8 from the structural armor plate layer is not drawn to scale. Likewise, shielded building B8 is symbolic and the spacing of the structural armor plate layer 146' from building B8 is not drawn to scale.

In FIG. 8 following explosive blast EXP8, ductile metallic strike layer 142' has been distorted. The distortion includes metallic strike surface layer 143', highly strain rate hardening polymer layer 144' and second metallic layer 145'. Fragments of metallic strike surface layer 143', highly strain rate hardening polymer layer 144' and second metallic layer 145' have been broken and separated at port pairs 155*a*' and 155*aa*', resulting in spall. FIG. 4 shows the common spall shapes. Size and shape are an artifact of the diameter of port pairs 155*a*' and 155*aa*' through which segments of the ductile metal sheet strike surface layer 142' was forced by the explosive blast EXP8. Spall includes highly strain rate hardening polymer layer 144'. Spall is contained in conduit 156'.

The dynamic response of conduit 156' to an explosive blast EXP8 has been simulated on digital computer. Conduit 156' has uniform diameter 155D. Explosive blast EXP8 generates blast waves traveling in a direction indicated by arrow 170 at velocities in the range of 1500 to 3000 meters/second and as shown, enter port 155*a*' and blast waves traveling in the direction indicated by arrow 171 that travel to and enter port 155*aa*'. Blast waves indicated by direction arrows 170 and 171 are of approximately equal magnitude and collide at the point identified as point Collision. A portion of the blast waves indicated by arrows 170 and 171 continue to and reflect off the back wall 200' of structural armor plate layer 146' as reflected waves in a direction indicated by arrows 210. Reflected wave arrows 210 meet blast wave arrow 170 and blast wave arrow 171 at point Collision. Point Collision is a point of high pressure where pressure waves collide resulting in cancellation of opposing blast waves. The shape of conduit 156' and proximity to back wall 200' cause the division of pressure waves with subsequent collision and cancellation.

A secondary mechanism in this embodiment is the generation of low mass, low momentum fragments contained within conduit 156' of structural armor plate layer 146'. As a result, explosive blast EXP8 does not significantly damage building B8. Portions of the blast wave from explosive blast EXP8 travel in oblique directions, indicated by direction arrow 300. These portions do not impact the shield. Their oblique direction assures that they also do not impact building B8.

This invention is shown by way of Example.

Example 1

Background

We investigated the blast performance of thin sheets of aluminum coated with a thin layer of Air Products VERSALINK® 1000 polyurea. The specified yield of the aluminum 5052 H32 alloy was 28 ksi. This compares with a specific yield of 51 ksi for DH-36 steel. The modulus of aluminum was ⅓ that of steel and the density was on the order of 40% of steel. The density and modulus of the aluminum were more closely aligned with the density and modulus of polyurea.

The polyurea coated aluminum sheet was supported with a structural armor plate. The support was made by cutting 2.3 inch diameter ports through the 2-inch thick by 9-square foot, HY-100 steel plate. A bevel of 45° around the diameter of each port on the surface of the plate extended the openings to 2.5 inches. This produced a structural armor plate with 49 equally spaced ports clustered at different distances from a central port. The obliquity and standoff varied with distance from the central port. The explosive charge was detonated directly over the center port with the remaining ports located at increasing standoffs and increasing obliquity by virtue of their diagonal orientation. The diaphragms over each port were the thin aluminum sheet, coated with polyurea set over the structural ballistic armor plate. A series of aluminum sheet samples were made with different polyurea coating thicknesses.

Test Set-Up and Procedure

In each test, an aluminum sheet was laid horizontally face up with an underlying structural steel plate for support. Wooden beams supported the steel plate off the ground. The 2-inch thick HY-100 steel plate had a uniform array of 49 equally-spaced ports traversing the plate. Each port had a 2.3-inch diameter with a 45 degree bevel on the explosion facing surface of the plate increasing the diameter of each port at the facing surface to 2.5-inches. Sheets of 0.04-inch thick aluminum 5052 H32 were tested with polyurea coating thicknesses of zero-inch, 0.02-inch, 0.04-inch, 0.08-inch, and 0.20-inch. The polyurea coatings were applied with a roller to the thin aluminum sheet except the 0.20-inch thickness which was applied by casting. Coating thicknesses were measured with a micrometer. An uncoated 0.06-inch thick aluminum sheet was included for comparison.

A pentolite charge was weighed. The charge was suspended by thin wire 1 foot above the center of the plate. The pentolite was a 1-to-1 mixture of pentoaerythritol tetranitrate and tetranitrotoluene. The charge shape was a right circular cylinder, with a 1-to-1 length-to-diameter ratio, oriented with its axis of symmetry in the vertical direction. Standoff of the charge from the center of each port varied from 12 inches directly above the center port to about 22.73 inches at about a 58 degree obliquity for the ports at the corners of the 2-inch thick HY-100 plate. Due to the symmetry of the pattern of ports in the plate, 1, 4, or 8 ports were located at each of 10 standoff distances.

After testing, the sheets were cleaned and photographed. We measure the maximum aluminum sheet deformation, i.e. dishing, manually with a profile gauge. Each sheet was weighed to give an additional estimate of average coating thickness.

We calculated peak pressures at the center of each port using a standard theory based method with empirical corrections. The calculated peak pressures experienced ranged from about 100 to 1600 psi. The applied pressures varied somewhat primarily due to the shape of the charge and secondarily due to factors including temperature and humidity.

Results

Standoff Variations

We used a profile gauge to measure aluminum deformation in each port from the initial surface of the aluminum to the point of maximum depth. As expected, less standoff distance and less obliquity corresponded with increased dishing depth. We found that dishing depths varied from 0.01 inches to 0.525 inches. At the greater standoffs dishing varied only from 0.025 inches to 0.125 inches.

Center Port Rupture

The port in the center of the sheet was located directly beneath the pentolite charge and had the least standoff to the charge. The largest deformations were measured at the center port and it was the only port location that ruptured. Of course, the depth of a ruptured port is not measurable. Three different test panels experienced some degree of rupture at the center port. Complete rupture occurred for the 0.04 inch aluminum sheet without a polyurea coating. The aluminum material above the port separated from the sheet in a single, distorted piece which would include both membrane stretching/dishing and edge separation. Partial rupture from edge separation occurred for the 0.04-inch aluminum sheet with a 0.04-inch polyurea coating. The material remained attached both by a small section of aluminum and a small section of polyurea at the same location. Finally, the uncoated 0.06 inch thick aluminum sheet also experienced partial rupture, that is, a circumferential crack around about 50% of the edge of the port.

It was noted that the 0.04-inch aluminum sheet coated with 0.02-inch polyurea did not rupture while equally thick aluminum sheets with coatings 2 times the thickness did rupture.

This indicated to us that the coating thickness was optimal for blast performance benefits. We concluded that additional polyurea thickness provided mass without benefit beyond weight equivalent aluminum. Therefore, the preferred thickness ratio of ductile metallic sheet strike surface layer:highly strain-rate sensitivity hardening polymer layer ranges from 2.25:1 to 1.75:1; preferably about 2:1.

Weight Comparison

Due to the symmetry of the sheet, all port locations/orientations besides the center port were exposed in groups of 4 or more. The results at duplicate locations/orientations showed some variation. In order to compare the performance of all of the test configurations the highest, lowest and average dishing depths measured at a specific location/orientation were graphed against the areal density of that sheet. From this, dishing depth was plotted against areal sheet density for the 20 ports closest to the center port.

The four ports nearest the center port were located about 12.83 inches from the pentolite charge at about a 21 degree obliquity. In this series of tests, the average dishing at this location indicated that on a weight basis there is an advantage to using a thin coating of polyurea on a thin aluminum sheet. The polyurea supports greater dishing prior to rupture and as a result, more energy absorption.

The data from the uncoated 0.06 inch aluminum sheet had too much spread for definitive interpretation. We noted that the greatest measured dishing of the 0.06 inch sheet at this close-in port location was well above the dishing of polyurea coated sheets and also has greater weight.

The four ports diagonally adjacent the center port were spaced 13.62 inches from the charge at about 28 degree obliquity. Here there was no apparent advantage or disadvantage on a weight basis for coating the aluminum sheets with polyurea. Measurements of the ports located 15.06 inches and 15.73 inches from the charge at about a 37 and 40 degree obliquity, respectively, provided no evidence of an advantage or disadvantage for using polyurea versus a weight equivalent of aluminum. Polyurea was better able to improve aluminum performance and protection from blast at closer standoffs where the rate and severity of incident blast wave was the greatest.

Example 2

Test Set-Up

Four vertically oriented panels were positioned around a pentolite explosive charge. The panels were mounted in large frames, with the center of the panel spaced 2.33 feet (28 inches) from a pentolite explosive charge having the same weight as the charge in Example 1, detonated on the top surface. The exposed surface of the barrier panel was 11 inches by 11 inches. The large frame width precluded the blast wave from encircling the blast panel and complicating the results. The free-field pressure at the 2.33 feet standoff was nominally 38 psi. However, the pressure was measured 8 inches behind the front face of the barrier or 3 feet from the charge detonation. Pressure was measured using a PCB Model 137A23 Quartz ICP® pressure pencil probe.

We used two different ported armor plate configurations. One armor plate had 16 ports having 2 inch diameters separated 0.6 inches edge-to-edge in a 4×4 square array. The other armor plate had 64 ports having 0.8 inch diameters separated 0.45 inches edge-to-edge apart in an 8×8 square array. A sheet of heavy duty, 0.001 inch thick aluminum foil was placed in front of the holes for many of the tests. In a second set of tests the 0.001 inch thick aluminum was coated on the back with a nominally 0.005 inch thick layer of VERSATHANE® polyurea polymer. An additional test was done using a 0.005 inch thick foil of aluminum with 0.4 inch diameter holes, separated 0.3 inches edge-to-edge.

Results—Blast Wave Shape and Arrival Time

One measure of performance is the shape and magnitude of the blast pulse and time of arrival at the pressure measuring gage location. Two identical tests were carried out without any barrier to measure a reference response to the blast. There was an initial large positive blast pulse that arrived in roughly 0.83 milliseconds which rose rapidly to a maximum and then dropped to zero at nominally 1.2 milliseconds. There was a second small positive pressure buildup at 1.7 milliseconds after the negative pressure phase of the initial portion of the blast wave. This bi-modal profile varied in shape and magnitude depending on the panel. The peak pressure was decreased by the ported panels and the time of the arrival of the pulse was increased by roughly 0.02 milliseconds with the ported panel. Adding foil to the front of the ported panels increased the blast pressure pulse arrival time slightly, and in the case of the 64 port panel, decreased the magnitude as well. The second positive pressure peak at 1.7 milliseconds was increased in magnitude as the ported panel with foil appeared to effectively chop the initial pressure pulse and delay it to a later time. The addition of the polymer backing made a difference in the time of arrival of the pulse, extending it by roughly 0.2 to 1.0 milliseconds. The pressure pushed to the second peak at roughly 1.7 milliseconds is significant with the second peak higher than the first.

In summary, the blast wave produced a bi-modal pressure profile where the initial peak pressure was retarded by the inclusion of foil and polymer on the ported panel. There was a second buildup after a 1.7 millisecond interval. Energy was apparently transferred between these two peaks, the initial pressure peak and a second pressure peak. The second pressure peak was often higher than the first, but all of the second pressure peaks were lower than the initial pulse for the case without any barrier.

Recorded explosive blast wave pressure profiles were examined side-by-side for comparison. For the 16 port and 64 port cases we saw that the first pressure peak was decreased by the addition of each panel element. When the second pressure peak was considered, neither peak was large compared to the case without any panel. The reduction in pressure magnitude for the best cases was at least 50 percent.

Impulse is the area under a pressure-time curve. The impulse curves for the foil and polymer were also bi-modal with the first peak lower in all cases. However, the maximum impulse was nearly the same for all cases. The best inventive panel reduced peak impulse up to 15% compared to the case without a panel.

Fourier Spectrum Analysis

We investigated modification of explosive blast frequency spectrum. Blast frequencies between 1000 and 3000 Hz have been correlated with pulmonary damage and other blast injuries. We used Fourier spectrum analysis to identify the distribution of frequency levels. Fourier spectra for the 16 port armor plate were compared to the case without an armor plate. It was found that the pentolite charges produced a distinct peak around 1500 Hz. That is in the center of the 1000 to 3000 Hz injury region identified by G. J. Cooper "Protection of the Lung from Blast Overpressures by Thoracic Stress Wave Decouplers", *Journal of Trauma: Injury, Infection, and Critical Care*, vol. 40, no. 3 (1996). This damaging frequency range is identified in FIG. 9 as the Cooper Injury Range.

Figure 9:
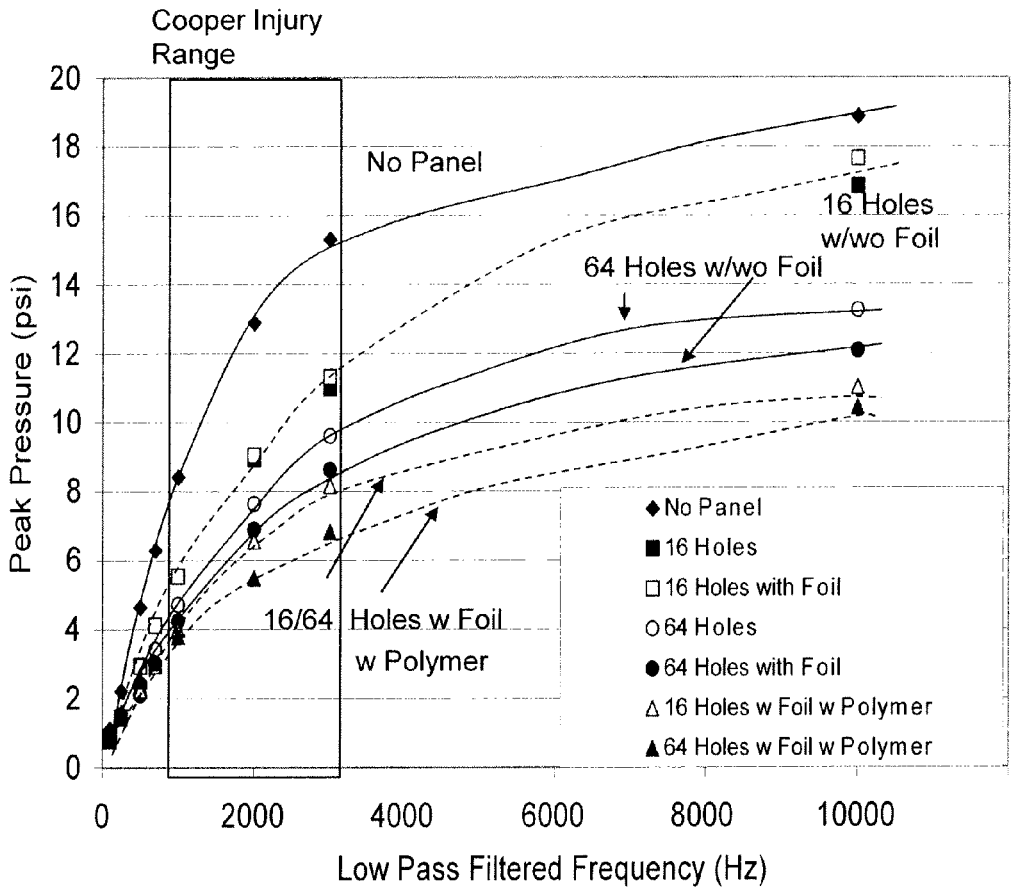
FIG. 9 is a plot of data demonstrating shield performance in reducing peak blast pressure at human injuring explosive blast frequencies.

FIG. 9 is a plot of data demonstrating the performance of six different panels in comparison to the performance with no panel present, labeled "No Panel". The six different panels with holes (ports) described above were:

1. 16 Holes with (w) Foil.
2. 16 Holes without (wo) Foil.
3. 64 Holes with (w) Foil.
4. 64 Holes without (wo) Foil.
5. 16 Holes with (w) Foil and Polymer.
6. 64 Holes with (w) Foil and Polymer.

FIG. 9 reports that panels of the invention lowered peak pressure in the Cooper Injury Range frequencies of 1000 to 3000 Hz.

Example 3

We tested an armor plate with 64 ports, 0.4 inches in diameter. A 0.005 inch thick foil overlay and a 0.005 inch thick foil overlay backed with polymer were tested. We found that an armor panel with 0.4 inch ports and 0.005 inch thick foil reduced the amplitude of 1000 to 3000 Hz frequencies. In another test the foil was back coated with polymer and a similar reduction in amplitude was measured.

Peak Frequency Reduction

A ported armor plate with foil back coated with polymer reduced the amplitude of damaging range frequencies. The 16 port plate performed better than the 64 port plate. We attributed this difference to the presence of the polymer. We observed that the polymer increased the capability of the foil to yield and finally to neck. The result was more parabolic deflection into the ports before rupture. At the ruptured ports, we noted a wide layer of polymer at the circumference of the ports indicating large stretching beyond the aluminum foil and snap back shape recovery. These polymer materials are known to demonstrate snap back shape recovery. There was also tearing in the mid region of the foil with polymer for the 64 port armor plate.

The foregoing discussion discloses and describes embodiments of the invention by way of example. One skilled in the art will readily recognize from this discussion, that various changes, modifications and variations can be made therein without departing from the spirit and scope of the invention as defined in the following claims.

What is claimed is:

1. A laminar blast shield panel including abutting layers consisting essential of:

(a.) a ductile strike layer including a metallic strike surface layer having a thickness of 0.001 to 0.25 inches;

(b.) a structural armor plate layer having an array of traversing ports, each traversing port having sufficient lateral area to allow deformation of the ductile strike layer through the structural armor plate layer.

2. The laminar blast shield of claim 1, wherein the ductile strike layer comprises a highly strain rate hardening polymer layer having a thickness of 0.005 to 0.25 inches, the polymer layer abutting the metallic strike surface layer and the structural ballistic armor plate layer, and wherein in the highly strain rate hardening polymer layer, the polymer is characterized in hardening at strain rates of 1,000/second and greater.

3. The laminar blast shield of claim 1, wherein the ductile strike layer comprises a highly strain rate hardening polymer layer having a thickness of 0.005 to 0.25 inches, the polymer layer abutting the metallic strike surface layer and a second metallic layer having a thickness of 0.001 to 0.25 inches, and wherein in the highly strain rate hardening polymer layer, the polymer is characterized in hardening at strain rates of 1,000/second and greater.

4. The laminar blast shield of claim 1 wherein the metallic strike surface layer includes a polyurea backing layer, and wherein in the polyurea backing layer, the polyurea is characterized in hardening at strain rates of 1,000/second and greater.

5. The laminar blast shield of claim 1, wherein in the structural ballistic armor plate layer, each traversing port has a diameter of 0.25 to 2 inches.

6. The laminar blast shield of claim 1, additionally comprising:

(c.) a spall liner spaced from the structural armor plate layer.

7. The laminar blast shield of claim 1, wherein the structural ballistic armor plate layer is 1 to 5 inches thick and the traversing ports range from 0.25 to 2 inches in diameter.

8. A laminar blast shield panel consisting essentially of:

(a.) a ductile strike layer including in sequence:

(i.) a metallic strike surface layer having a thickness of 0.001 to 0.25 inches, (ii.) a confined, highly strain rate hardening polymer layer having a thickness of 0.005 to 0.25 inches, and wherein in the highly strain rate hardening polymer layer, the polymer is characterized in hardening at strain rates of 1,000/second and greater, and (iii.) a second metallic layer having a thickness of 0.001 to 0.25 inches;

(b.) an abutting structural ballistic armor plate layer having an array of traversing ports there through, each traversing port having a diameter of 0.25 to 2 inches.

9. The laminar blast shield of claim 1, wherein the structural ballistic armor plate layer is 1 to 5 inches thick.

* * * * *